United States Patent [19]

Qureshi

[11] 4,117,862

[45] Oct. 3, 1978

[54] PRESSURE COMPENSATED CONTROL VALVE

[75] Inventor: Azam S. Qureshi, Racine, Wis.

[73] Assignee: Tomco, Inc., Racine, Wis.

[21] Appl. No.: 765,877

[22] Filed: Feb. 7, 1977

[51] Int. Cl.[2] ..... F15B 13/04

[52] U.S. Cl. ..... 137/596.13; 91/446; 137/625.68

[58] Field of Search ..... 137/596, 596.12, 596.13, 137/625.68; 91/446

[56] References Cited

U.S. PATENT DOCUMENTS

| | | | |
|---|---|---|---|
| 3,136,328 | 6/1964 | Hipp | 137/596 B X |
| 3,910,311 | 10/1975 | Wilke | 137/596 |
| 3,985,153 | 10/1976 | Thomas | 137/596 |

FOREIGN PATENT DOCUMENTS

| | | | |
|---|---|---|---|
| 2,600,776 | 7/1976 | Fed. Rep. of Germany | 137/596 |

*Primary Examiner*—Gerald A. Michalsky
*Attorney, Agent, or Firm*—Ronald E. Barry

[57] ABSTRACT

A pressure compensating valve spool assembly for a hydraulic flow control valve the spool assembly being slidably positioned in the central bore of a valve housing for movement from a neutral position wherein fluid will flow through the valve assembly to reservoir to operative positions in either direction to provide fluid communication between fluid inlet passages to one of a pair of cylinder passages in the valve housing, the other of said cylinder passages being connected to one of the pair of reservoir passages. The valve spool assembly includes a symmetrical valve spool having valve members at each end which are responsive to variations in the pressure relation between inlet pressure and cylinder pressure to control the fluid flow rate to the cylinder passage. Any excess flow is bypassed to reservoir at minimum pressure loss.

5 Claims, 3 Drawing Figures

PRESSURE COMPENSATED CONTROL VALVE

BACKGROUND OF THE INVENTION

Pressure compensating hydraulic control valves are used to control the motion of lifting devices which are responsive to the forces produced by hydraulic piston and cylinder assemblies. In order to eliminate sudden or jerky motions of the lifting device, pressure compensating valve spool assemblies have been incorporated into the hydraulic control valve to control the flow rate of the hydraulic fluid to the hydraulic piston and cylinder assembly. One such valve spool assembly is shown in U.S. Pat. No. 3,985,153 entitled "Pressure Compensating Valve Spool Assembly for a Hydraulic Control Valve", which is assigned to the same assignee as the present invention. Although the valve assembly provides pressure compensation of the flow to the cylinder passages, the valve spool was not symmetrical and had to be installed in a specific manner. Further, excess flow was directed to tank port at relief valve pressure setting thus resulting in excessively high horsepower loss.

SUMMARY OF THE INVENTION

The pressure compensating valve spool assembly of the present invention includes a symmetrical valve spool which is responsive to pressure variations between inlet and cylinder pressure. Valve members provided in the valve assembly modulate flow and eliminate jerky motions of the lifting device during sudden changes in cylinder pressure. Excess flow is bypassed to reservoir at minimum pressure and power loss. Since the valve spool is symmetrical, it can be installed in the valve housing in either direction without affecting the operation of the pressure compenating device.

DRAWINGS

DESCRIPTION OF THE INVENTION

Figure 1:
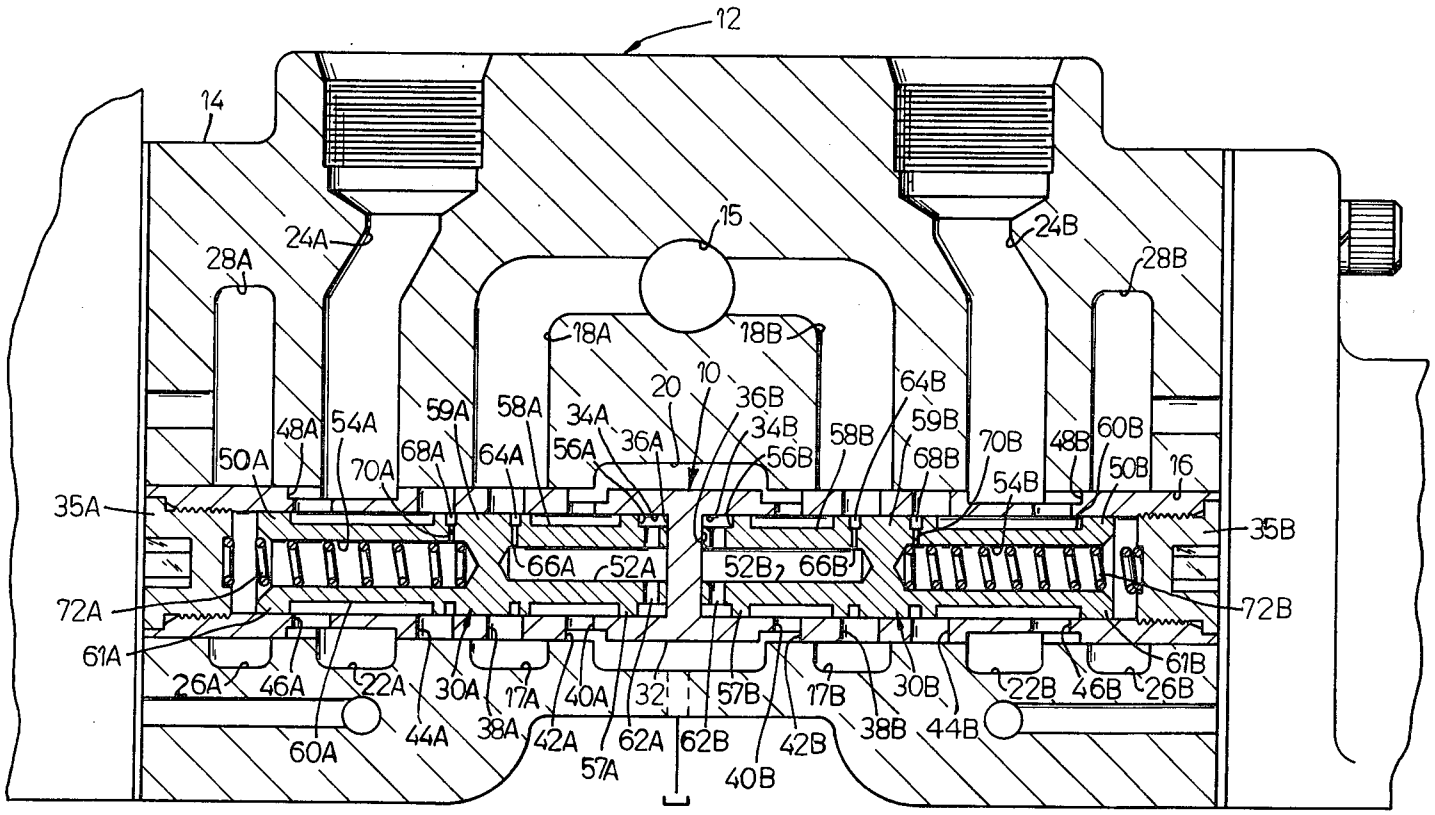
FIG. 1 is a side elevation view in section of the hydraulic control valve showing the valve spool assembly in the neutral position with no fluid pressure in the inlet passages.

The spool assembly 10 of the present invention is used to control the flow rate of hydraulic fluid through a control valve 12. The valve 12 includes a housing 14 having a central bore 16 and a fluid inlet port 15 connected to a pair of annular recesses 17 by a pair of inlet passages 18A and 18B. The bore 16 is connected to a reservoir or tank by an annular recess 20 intermediate the annular recesses 17. The housing 14 includes a pair of cylinder passages 24A and 24B connected to a pair of annular recesses 22 and a pair of exhaust passages 28A and 28B connected to a pair of annular recesses 26.

The spool assembly 10 is moved from a neutral or open center position, FIG. 1, to operative positions to direct fluid from the inlet ports 18A and 18B to the respective cylinder ports 24A or 24B. The spool assembly 10 can be moved manually or by any conventional control device provided at each end of the valve housing. In accordance with the invention means are provided in the spool assembly 10 for compensating for pressure variations between inlet pressure and cylinder pressure. Such means is in the form of valves 30A and 30B provided in the spool assembly 10.

The spool assembly 10 includes a symmetrical main spool 32 having blind bores 34A and 34B at each end. The bores 34A, 34B are closed by means of caps 35A, 35B threadedly received in each end of the blind bores. The blind bores 34A and 34B terminate internally at a common wall 36 which provides internal stops 36A and 36B for each of the valves 30A and 30B, respectively. The blind bores 34A and 34B are connected to the inlet passages 18A and 18B by means of ports 38A and 38B. Fluid flow from the blind bores 34A and 34B is provided to the annular recess 20 by means of ports 40A and 40B and annular grooves 42A and 42B. Fluid from the inlet passage 18A to the cylinder ports 24A and 24B is provided by means of ports 44A and 44B, ports 46A and 46B and annular recesses 48A and 48B.

Pressure compensation of fluid flow through the ports 44A and 44B is provided by means of the valves 30A and 30B. In this regard, each of the valves includes a cylindrical member 50A and 50B slidably mounted within the blind bores 34A and 34B, respectively. Each valve member includes a blind bore 52A and 52B at the inner end and a blind bore 54A and 54B at the outer end. Annular grooves 56A, 56B, 58A, 58B; and 60A, 60B are provided in the outer periphery of the cylindrical member 50A and 50B, respectively, to define lands 57A, 57B; 59A, 59B, and 61A, 61B. Fluid communication is provided between blind bores 52A, 52B and annular recesses 56A, 56B by means of ports 62A and 62B. The inner end of blind bores 52A and 52B are connected to annular grooves 64A, 64B by means of restrictive orifices 66A, 66B. Fluid communication is provided between the inner ends of blind bore 54A and 54B and annular grooves 68A, 68B by means of restrictive orifices 70A, 70B.

The valve members 30A, 30B are biased into engagement with the internal stops 36A and 36B by means of springs 72A, 72B provided in blind bores 54A and 54B. In this regard, the springs 72A, 72B are seated in receses provided in caps 35A and 35B. It should be noted that the caps 35A, 35B are normally spaced from the valve members 50A, 50B.

FIG. 1

In FIG. 1, the spool assembly 10 is shown in the neutral position with no fluid pressure in the passages 18A or 18B. The springs 72A and 72B, in the absence of pressure in the inlet passages 18A and 18B, will move the valve members 30A and 30B toward or into engagement with the internal stops 36A and 36B. This will close both of the cylinder passages.

FIG. 2

Figure 2:
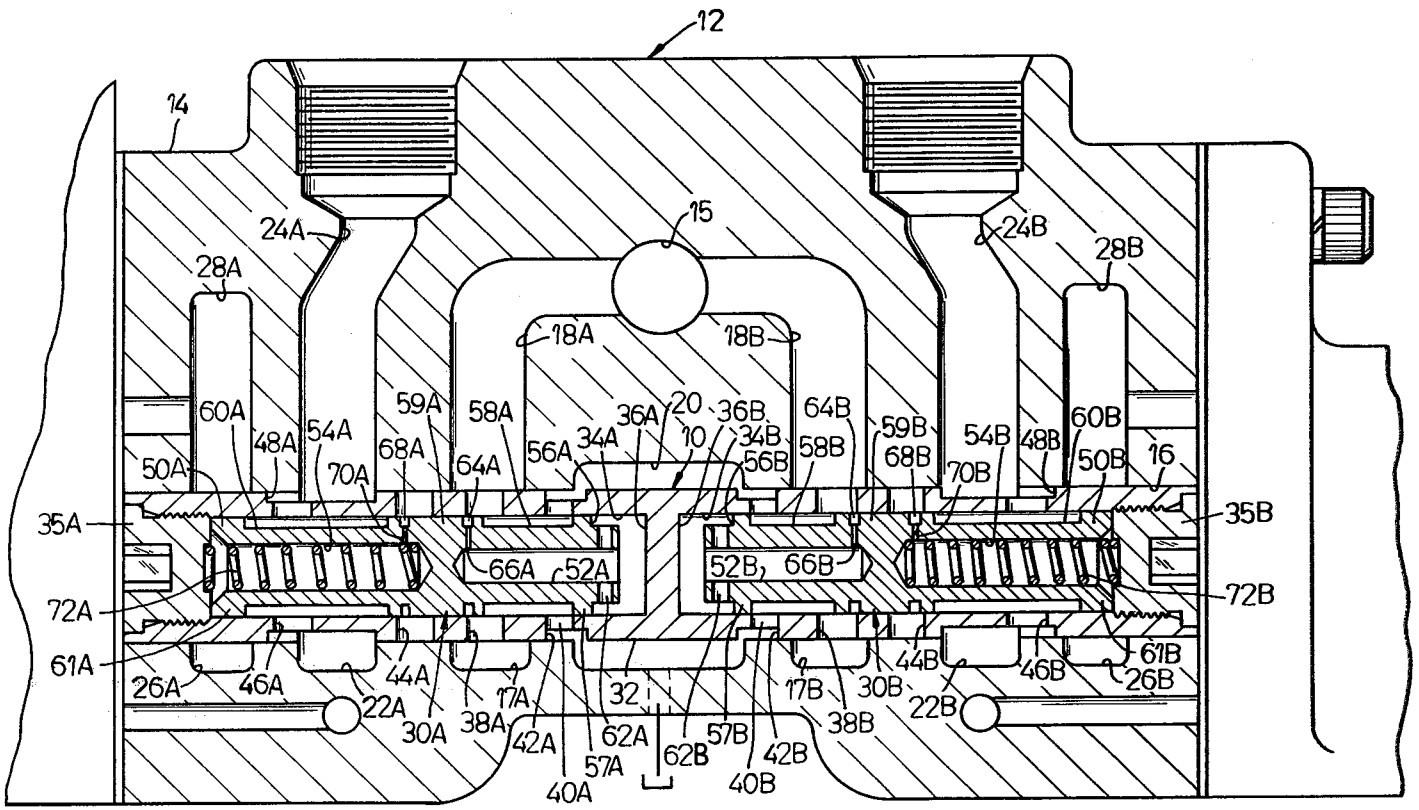
FIG. 2 is a side elevation view of the hydraulic control valve having the valve spool assembly in the neutral position with fluid under pressure in the inlet passages.

When the spool assembly 10 is in the neutral position, FIG. 2, and fluid under pressure enters the inlet port 15 and pressure passages 18A and 18B, the fluid will pass through the ports 38A and 38B into blind bores 34A and 34B in the valve spool. The fluid will flow through the annular grooves 64A and 64B and orifices 66A and 66B into the blind bores 52A and 52B in the poppet valve members 50A and 50B. The fluid in the blind bores 52A and 52B will flow through ports 62A and 62B into the annular grooves 56A and 56B provided at the inner end of the valve members. The pressure build up in the space defined by the annular groove 56A, 56B will eventually exceed the bias force of the spring 72A and 72B moving the valve members toward the caps 35A and 35B. When the lands 59A and 59B clear the edge of the ports 38A and 38B, fluid will flow into the annular grooves 58A, 58B and out through the ports 40A and 40B and grooves 42A, 42B into the bypass recess 20.

FIG. 3

In accordance with the invention, the valves 50A, 50B provide pressure compensation between the fluid pressure in passages 18A or 18B and the corresponding cylinder passage 24A, 24B. In this regard it should be noted that the fluid flow rate is initially determined by the size of the orifice formed by the opening of the port 44A or 44B when the spool assembly 10 is moved from the neutral position to an operative position either to the right or to the left of center. Pressure compensation is achieved by controlling the position of land 59A or 59B with respect to the port 44A or 44B.

Figure 3:
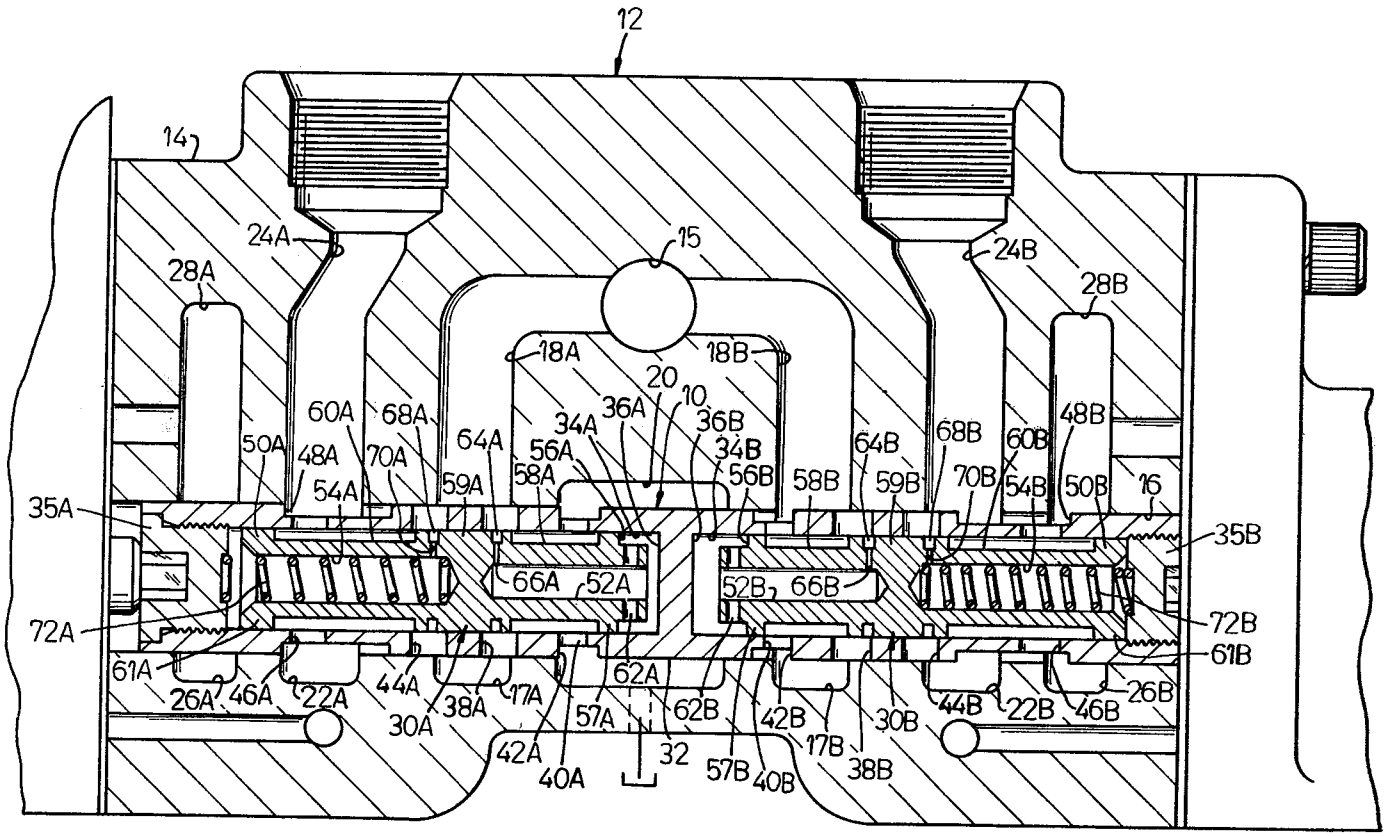
FIG. 3 is a side elevation view of the hydraulic control valve showing the valve spool assembly moved to one of the operative positions.

When the spool assembly 10 is moved to the right as seen in FIG. 3, the port 44A will be open and in fluid communication with inlet pressure passage 18A. Annular groove 48B will provide fluid communication between passages 24B and 28B. Fluid will flow through the port 44A, annular groove 68A and orifice 70A into the blind bore 54A in valve member 50A. The pressure build up in the bore 54A will move the valve member 50A toward the right. Fluid will flow from the inlet passage 18A through the port 44A into the annular groove 60A in the valve member 50A and out through port 46A into the cylinder passage 24A. The valve member 50A will assume a balanced position which depends on the force relation between the inlet pressure of the fluid in bore 52A and the closed end of the blind bore 34A and the force of the fluid pressure in the blind bore 54A plus the force of the bias spring 72A. The land 59A will establish a flow orifice between port 44A and annular groove 60A. Any variation between inlet pressure and cylinder pressure will produce a corresponding movement in the position of land 59A in the valve member relative to the port 44A. As the port 44A is opened by land 59A, the port 38A will be closed by the other end of land 59A.

The embodiments of the invention in which an exclusive property or privilege is claimed are defined as follows:

1. A pressure compensating hydraulic flow control valve spool assembly for a hydraulic valve having a housing including a main bore, a fluid inlet passage, a tank passage, a pair of cylinder passages and a pair of exhaust passages connected to said main bore, said valve spool assembly comprising a symmetrical valve spool slidably positioned in said main bore for movement in either direction from a neutral position to operative positions, and valve means mounted within said spool for providing a pressure controlled flow of fluid between said fluid inlet passage and said tank passage when said spool is in the neutral position, said valve means controlling the flow rate between the fluid inlet passage and one of the cylinder passages when the spool is moved to one of the operative positions.

2. The assembly according to claim 1 wherein said valve means comprises a valve provided in each end of said spool and means for biasing said valves to a closed position to prevent fluid flow through said spool when fluid inlet pressure is not sufficient to overcome said bias means.

3. The assembly according to claim 1 wherein said spool includes a blind bore at each end, a first pair of ports in said valve spool for connecting said blind bores to said tank passage, a second pair of ports in said spool for connecting said blind bores to said inlet passage, a third pair of ports in said spool for connecting said inlet passage to said blind bores, and a fourth set of ports in said blind bores for connecting said blind bores to said cylinder passages, said valve means including valve members positioned in said blind bores for controlling fluid pressure flow between said second port and said first port and between said third port and said fourth port, and means for biasing said valve member to a position to prevent fluid flow from said second port to said first port.

4. The assembly according to claim 3 wherein said valve member includes a blind bore at the internal end and a restricted orifice for providing fluid communication between said second ports and said blind bore in said valve member whereby fluid flow from said inlet passage will flow into said blind bore in said valve member to allow for the build up of fluid pressure in said blind bore in said valve member until the force acting on the valve member is sufficient to overcome the bias means to allow the valve member to move far enough to connect the inlet passage through said second port to the tank passage through said first port whereby fluid at inlet pressure is bypassed to said tank passage at minimum pressure loss.

5. A pressure compensating control valve spool assembly for a hydraulic valve having a housing, a main bore in said housing, an inlet passage and a tank passage connected to said bore, and a cylinder passage connected to said bore, said valve spool comprising a symmetrical spool slidably positioned in said bore for movement from a neutral position to an operative position, valve means within said spool responsive to inlet pressure for controlling the flow rate through the spool between the inlet passage and the tank passage in the neutral position, said valve means in the operative position of the spool controlling the flow rate between the inlet passage and the cylinder passage.

* * * * *